United States Patent [19]

Whaling

[11] Patent Number: 4,610,321

[45] Date of Patent: Sep. 9, 1986

[54] CAVITATING JET DEVICE

[76] Inventor: Michael H. Whaling, 1966 Millwood Cr., Sudbury, Ontario, Canada, P3E 2T2

[21] Appl. No.: 715,619

[22] Filed: Mar. 25, 1985

[51] Int. Cl.[4] ..... E21B 7/18

[52] U.S. Cl. ..... 175/422 R

[58] Field of Search ..... 175/422, 67, 65; 299/16, 17

[56] References Cited

U.S. PATENT DOCUMENTS

| | | | |
|---|---|---|---|
| 2,785,875 | 3/1957 | Hayes | 175/422 |
| 3,061,022 | 10/1962 | Wells | 175/422 |
| 3,112,800 | 12/1963 | Bobo | 175/422 |

*Primary Examiner*—Stephen J. Novosad

*Assistant Examiner*—Thuy M. Bui

*Attorney, Agent, or Firm*—Ridout & Maybee

[57] ABSTRACT

A device for applying cavitating liquid jets to a work surface has an annular work surface engaging area surrounding a chamber, recessed into the device and with an open end adjacent the working surface, a jet nozzle on the opposite side of the chamber which projects a high velocity liquid jet against the working surface, and passages extending from the chamber to the interior of the tool and providing the main route for escape of spent liquid, the passages being calibrated so as to maintain the chamber full of liquid without engendering a substantial pressure rise within the chamber. The velocity of the liquid jet is high enough that shear between the jet and the spent liquid causes cavitation.

5 Claims, 1 Drawing Figure

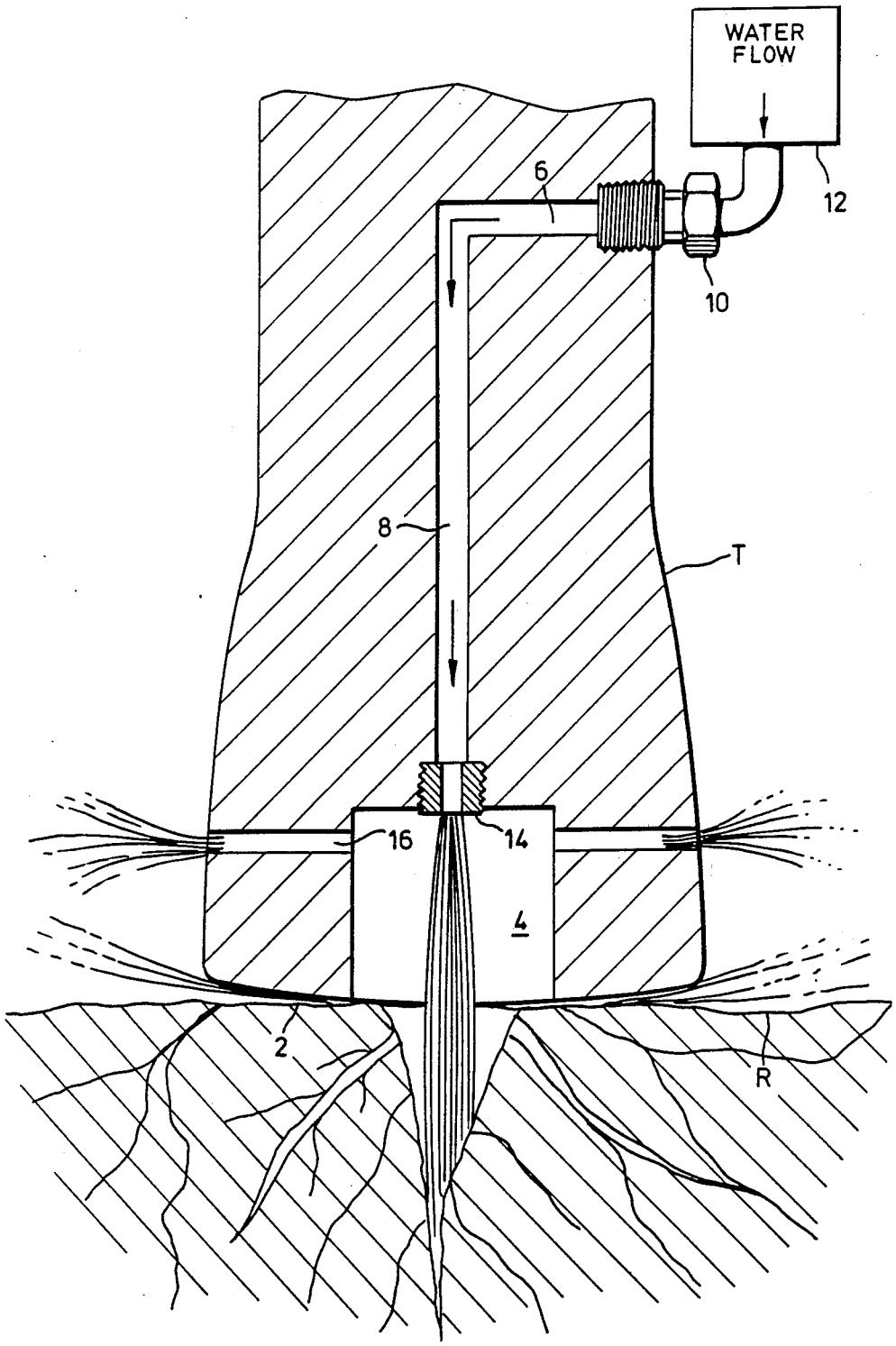
WATER
FLOW
6
12
10
8
T
16
14
4
2
R

CAVITATING JET DEVICE

This invention relates to the exploitation of cavitation phenomena to facilitate the cutting, erosion or fragmentation of material utilizing a high velocity liquid jet.

Such techniques rely on the production of vapour cavities within the liquid of the jet, which cavities collapse or implode at or adjacent the surface of the material to be worked upon, setting up intense local shock waves which assist in disintegrating material to be removed from the workpiece. In any operative system, it is necessary first to produce the cavities and secondly to ensure that their collapse is concentrated in a desired working zone.

The state of the art in such techniques is extensively discussed in U.S. Pat. Nos. 4,193,635 (Thiruvengadam et al) and 4,389,071 (Johnson Jr. et al). As study of these patents will show, two main techniques have been adopted to induce cavitation in liquid jets, either independently or in combination. The first technique utilizes specially configured jet nozzle constructions to produce turbulence which induces cavitation, the effect being possibly enhanced by the exploitation of resonance phenomena in the nozzle structure. This approach is typified by the abovementioned Johnson patent and a number of earlier patents naming the same inventor. It is recognized that surrounding the emerging jet with relatively static liquid can help sustain the cavities until they reach a working zone, and that shear effects between the jet and the surrounding liquid may enhance the cavitation effect. Such shear effects are the basis of the second main technique utilized to induce cavitation in liquid jets and are described in detail in the Thiruvengadam et al patent. In simplified language, this discussion may be summarized as follows.

Cavitation occurs when a very high speed jet of liquid is projected through an amount of relatively static liquid. The cavities are generated as a result of the spinning of the free liquid which surrounds the fast moving jet into very high speed vortices, the interiors of which, due to centrifugal force, fall in large part to a pressure below the vapour pressure of the liquid, thus forming bubbles, or cavities, which are naturally carried downstream by the momentum of the high speed jet. At some point downstream of their inception, these bubbles will collapse and in doing so, develop very high transient energy levels. If this collapse is on or near a target, damage to the structure of the target can occur.

The present invention is concerned with devices utilizing such shear induced cavitation.

As will be apparent from the above references, the distance between the jet nozzle and the target is fairly critical. Furthermore, it will be appreciated that it is fundamental to exploitation of liquid shear effects that the jet operates submerged in a body of liquid, whilst the target itself will not necessarily be in a submerged location. Both of these problems have been considered in the prior art and the solutions proposed by Thiruvengadam et al are typical. Thus in FIG. 8, Thiruvengadam discloses a flexible shroud to which water is supplied through a pipe 152. The depth of water within the shroud is controlled by an overflow orifice or orifices 153. It is contemplated that water from the jet and the external supply will escape between the shroud and the workpiece (and apparently through the workpiece in the example shown). In FIG. 9, an adjustable gauge rod is provided to control the distance between the jet nozzle and the workpiece. Other proposals have been made to provide sensor means which sense the target location and control the location of the jet nozzle accordingly.

One potentially valuable application of devices of the class discussed is the fragmentation of rock in mining operations. It will be obvious that any mechanism which contacts the rock during such an operation will be subject to considerable wear and tear; arduous working conditions and irregular and abrasive targets are also typical of many other potential applications. Arrangements such as those shown in Thiruvengadam are unlikely to be adequate in such applications. Furthermore, with a rough and irregular target such as a rock face, it would be difficult to maintain the shroud full of water without one the one hand requiring the supply of large quantities of water to the shroud, and on the other hand risking erratic variations of hydraulic pressure within the shroud as the rate of leakage between the shroud and the rock face varies.

In U.S. Pat. No. 4,342,475 (Vickers) there is disclosed the use of a rigid shroud of robust construction to surround a flow of low pressure water providing artificial submergence of a cavitating jet. However, in a paper presented at the Fifth International Symposium on Jet Cutting Technology, held at Hanover, West Germany on June 2–4, 1980, the inventor and coauthors state "A tubular shroud around the cavitation jet did not lead to improvements in cavitation and had the distinct disadvantage of requiring positive surface contact and of increasing the reaction thrust on the operator.". The shroud in this case was provided with openings adjacent the target surface to allow the water to escape. It should be noted that the Vickers patent and Vickers et al paper relate to cavitating jet techniques of the type in which cavitation is induced by configuration of the jet nozzle.

U.S. Pat. No. 4,124,162 (Schwab) also discloses use of a "shroud" around a high speed fluid cutting jet. A function of this shroud appears to be to induce cavitation in the jet by acting as an expansion chamber, and the dimensions of the shroud are clearly fairly critical since the jet must apparently expand within the shroud so as to meet its walls upstream of its open end, thus engendering a partial vacuum within the remainder of the shroud cavity. It thus appears that the shroud can more accurately be regarded as forming part of the nozzle assembly, and that the effective jet orifice is at the downstream end of the shroud. This downstream end is spaced from the target surface so as to optimize the cutting effect.

Rather surprisingly in view of the teaching of Vickers and Schwab, I have found that a very effective cavitating jet apparatus may be constructed utilizing a rigid, workpiece contacting shroud member to define a chamber surrounding the jet, provided that certain conditions are met.

According to my invention there is provided a liquid jet device for direction application to a working surface to be treated, comprising a body defining walls of a cavitation chamber, the chamber having an open end facing the working surface and the body being shaped to contact the working surface in an annular zone surrounding the open side of the cavitation chamber, a source of high pressure liquid, a jet nozzle connected to said source and supported in said body on a side of the cavitation chamber opposite said open end and directed towards said open end so that a jet of high pressure liquid ejected from said nozzle will impact the working surface in a zone within and spaced from said annular zone, at least one vent opening in the walls of the cavitation chamber and spaced from said open end, the flow capacity of said at least one vent opening being large compared with leakage between the annular zone and the working surface, large enough to exhaust the liquid from said cavitation chamber without engendering a pressure rise in the chamber sufficient to suppress cavitation therein, and small enough to ensure retention of sufficient liquid in the chamber to submerge the liquid jet, the pressure of the source of high pressure liquid, the dimensions of the jet nozzle and the distance between the nozzle and the open end of the cavitation chamber being such that shear between the liquid jet and the liquid retained in the chamber will induce cavitation vortices and sustain them until impact with the working surface.

These and further features of the invention will be understood from the following description of a preferred embodiment thereof with reference to the accompanying drawing.

The single FIGURE of drawing shows a longitudinal section through a device in accordance with the invention.

Referring to the drawing, there is shown the distal end portion of an impact tool T in accordance with the invention, in contact with a rock face R. The tool shown is a generally cylindrical rod forming a hammer with a maul head and presenting a frontal surface 2 of substantial area, which is held against the rock face R and subjected to repeated impacts by a mechanism which is not shown and which in itself forms no part of the invention. The surface 2 contacts the rock face R in an annular region surrounding a cylindrical cavitation chamber 4 formed coaxially with the rod in the centre of surface 2. The tool T is provided with drillings 6 and 8 forming a passage between a connection 10 to a source 12 of high pressure water, and a nozzle 14 threaded into a bore coaxial with the rod and in the side of the chamber 4 opposite an open side of the chamber at the rock face R. The nozzle 14 is so configured and directed that a jet of high pressure liquid ejected therefrom will impact the rock face in a zone within and spaced from the annular region of the surface 2 which contacts the rock face. One or more further drillings 16 (two are shown) form openings in the walls of the cavitation chamber 4 which are spaced from the open end of the chamber and are calibrated to allow water to escape from the chamber sufficiently readily to avoid engendering an excessive pressure rise in the chamber whilst maintaining the chamber full of water so as to submerge the jet from the nozzle 14. Both the nozzle 14 and the drillings 16 are selected so that under normal operating conditions, leakage between the surface 2 and the rock face R will be sufficiently small compared with the flow through the drillings 16 that the latter are the dominant factor in determining the pressure within the chamber 4. The pressure and capacity of the source 12 is selected relative to the nozzle 14 so that shear between the liquid jet and the liquid retained in the chamber will induce cavitation vortices and sustain them until impact with the working surface.

Although the invention is not necessarily embodied in an impact device such as a hammer, and may be incorporated into a non-impact tool, it is a feature of the invention that the cavitation chamber is defined in a body which has an annular contact zone with a working surface to be treated with a liquid jet, which body may be as robust as necessary to sustain the wear and tear to which it may be subjected. It is not necessary either that the contact zone between the body and the working surface be water-tight on the one hand, or that it permit escape of the liquid from the jet on the other hand, since the openings 16 provide the principal route for the escape of water from the chamber. The body or tool should of course be held sufficiently closely against the work surface that this condition is met, and so that the spacing between the nozzle 14 and the working surface is accurately maintained.

In calibrating the openings 16, it should be borne in mind that some pressure increment within the chamber 4 may be advantageous in increasing the intensity of the cavitation phenomenon. To induce cavitation, the local pressure within the induced vortices must drop below the vapour pressure of water, which at normal ambient temperatures is very small. Thus if the pressure in the chamber 4 is close to atmospheric, the maximum local pressure drop in the vortices is approximately one atmosphere. If however the pressure in the chamber 4 is about two atmospheres, the maximum local pressure drop in the cavities is doubled, with an increase in the intensity of cavitation. A greater jet velocity will of course be required to induce cavitation, but this will generally be obtained readily provided that the pressure increment in the chamber is no more than a few atmospheres. This pressure will in any event be very small compared with the pressure of the liquid feeding the nozzle 14. Typically the feed pressure will be of the order of 200 to 800 atmospheres but may be more or less provided that the required cavitation is obtained.

In a test, a bit similar to that shown in cross-section in the Figure was built. This bit was circular in end view and had a maximum diameter of 15 cm. The drillings 6 and 8 had diameters of 13 mm. The chamber 4 had a diameter of 19 mm and was 7.5 cm long. The nozzle was a simple threaded plug with a 2 mm orifice. Four openings 16 had diameters of 6.35 mm, and were tapped and threaded to accept removable plugs at their outside ends. They intersected the chamber 25 mm from the nozzle.

In order to determine the effect of the bleed holes, a simple test was run by placing the test bit on a concrete aggregate slab about 7.5 cm thick. Water was supplied at a flow rate of 90 liters/minute and a maximum pressure of about 7 MPa by means of a positive displacement pump forming the source 12. It was found that a hole was bored through the concrete in less than three seconds from the time at which the pressure reached about 400 KPa in each of three runs with the openings 16 unplugged. A similar hole took from 45 to 90 seconds to bore in three runs with the openings 16 plugged.

In a further test, the tool was placed on the same target material and a good interface was observed between the target and the tool. A water supply pressure of 6.9 MPa was used at a supply rate of 113.65 liters per minute. The time to penetrate through to target material was recorded for each of the following five test runs:

Run One: As above, with all four openings 16 clear—time to penetrate 1.5 seconds.

Run Two: As above, with one opening plugged—time to penetrate 2 to 3 seconds.

Run Three: As above, with two openings plugged—time to penetrate, 9 seconds.

Run Four: As above, with three openings plugged—time to penetrate, 11 seconds.

Run Five: As above, with all four openings plugged, time to penetrate, 30 seconds.

A further exploratory test was conducted in which the nozzle was held unshrouded a distance of 7.5 cm from the target. A test was run at the same pressure and volume as above. No penetration occurred after several minutes of running.

As can be seen, excessive increases in pressure of the waste or spent water in the chamber has a negative effect on the development of cavitation.

In addition to the above test, the bit was used in a hydraulic impactor which delivered blow energy of about 2,700 joules at 120 blows per minute. The water pressure was about 7 to 8 MPa and the flow rate about 80 liters per minute. The impactor was mounted on a carrier and the tool was used to strike a solid rock face of disseminated nickel ore about 4 meters by 6 meters. The system produced about 800 kg of muck in the equivalent of about 5 minutes of continuous impacting. In a control run, with no water flow, only spalling and dust were produced but no muck.

The pressure and flow rate of the water, the dimensions of the bit and of the chamber, nozzle and drillings therein, and the distance from the nozzle to the open end of the chamber, may be varied according to the material which it is desired to treat. Of course, the pressure, flow rate, and velocity of the water jet are interrelated. An increase in pressure will generally result in an increase in the velocity of the water jet and in flow rate. The liquid which is used need not necessarily be water, although water will probably be the cheapest and most convenient liquid to use. If a liquid other than water is used, it may be necessary to adjust the operating parameters to achieve the desired effects. Furthermore, the exact position and configuration of the passages 16 and their outlets, and the position and configuration of the annulus and nozzle, although not critical, may advantageously be optimized on an empirical basis.

I claim:

1. A liquid jet device for direct application to a working surface to be treated, comprising a body defining walls of a cavitation chamber, the chamber having an open end facing the working surface and the body being shaped to contact the working surface in a continuous annular zone surrounding the open side of the cavitation chamber, a source of high pressure liquid, a jet nozzle connected to said source and supported in said body on a side of the cavitation chamber opposite said open end and directed towards said open end so that a jet of high pressure liquid ejected from said nozzle will impact the working surface in a zone within and spaced from said annular zone, at least one vent opening in the walls of the cavitation chamber and spaced from said open end, the flow capacity of said at least one vent opening being large compared with leakage between the annular zone and the working surface, large enough to exhaust the liquid from said cavitation chamber without engendering a pressure rise in the chamber sufficient to suppress cavitation therein, and small enough to ensure retention of sufficient liquid in the chamber to submerge the liquid jet, the working pressure of the source of high pressure liquid, the dimensions of the jet nozzle and the distance between the nozzle and the open end of the cavitation chamber being such that shear between the liquid jet and the liquid retained in the chamber will induce cavitation vortices and sustain them until impact with the working surface.

2. A device according to claim 1, wherein the body is a distal portion of a rod, the chamber is a cylindrical bore extending coaxially into the rod from its distal end, the nozzle is located at the inner end of the chamber coaxial with the rod, and the vent openings are formed by bores extending between the longitudinal surface of the rod and the cylindrical bore.

3. Apparatus according to claim 1, wherein the working pressure of the liquid source is about 200 to about 800 atmospheres.

4. A method for cutting, eroding or fragmenting a solid material, comprising placing in intimate contact with a working surface of the material to be treated a body defining walls of a cavitation chamber, the chamber having an open end facing the working surface and the body being shaped to bed against the working surface in a continuous annular zone surrounding the open side of the cavitation chamber, supplying high pressure liquid to a jet nozzle supported in said body on a side of the cavitation chamber opposite said open end and directed towards said open end so that a jet of high pressure liquid ejected from said nozzle impacts the working surface in a zone within and spaced from said annular zone, venting liquid from said chamber through at least one vent opening in the walls of the cavitation chamber and spaced from said open end, the flow through said at least one vent opening being large compared with leakage between the annular zone and the working surface, large enough to exhaust the liquid from said cavitation chamber without engendering a pressure rise in the chamber sufficient to suppress cavitation therein, and small enough to ensure retention of sufficient liquid in the chamber to submerge the liquid jet, the pressure of high pressure liquid being maintained at a sufficient level, relative to the dimensions of the jet nozzle and the distance between the nozzle and the open end of the cavitation chamber, that shear between the liquid jet and the liquid retained in the chamber induces cavitation vortices and sustains them until impact with the working surface.

5. A method according to claim 4, wherein the pressure of the high pressure liquid is between 200 and 800 atmospheres.

* * * * *